US010045600B2

(12) United States Patent
Apodaca

(10) Patent No.: US 10,045,600 B2
(45) Date of Patent: Aug. 14, 2018

(54) CONTAINER WITH QUICK RELEASE BASE AND LID ASSEMBLY

(71) Applicant: HCT GROUP HOLDINGS LIMITED, Central (HK)

(72) Inventor: Adrian Charles Apodaca, Daly City, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 0 days.

(21) Appl. No.: 14/858,345

(22) Filed: Sep. 18, 2015

(65) Prior Publication Data

US 2016/0083153 A1 Mar. 24, 2016

Related U.S. Application Data

(60) Provisional application No. 62/052,101, filed on Sep. 18, 2014.

(51) Int. Cl.
*A45D 34/04* (2006.01)
*A45D 40/26* (2006.01)

(52) U.S. Cl.
CPC ..... *A45D 34/045* (2013.01); *A45D 40/265* (2013.01)

(58) Field of Classification Search
CPC .. A45D 40/265; A45D 40/267; A45D 34/045; B65D 51/32; B65D 45/32; B65D 45/322; B65D 55/12; F16L 37/098
See application file for complete search history.

(56) References Cited

U.S. PATENT DOCUMENTS 118,223 A 8/1871 Evans
753,968 A 3/1904 Farmer
(Continued)

FOREIGN PATENT DOCUMENTS

CN 1736816 A 2/2006
CN 2866193 Y 2/2007
(Continued)

OTHER PUBLICATIONS

Beauty and Fashion Tech, "L'Oreal True Match Roller Foundation" retrieved on Jul. 21, 2010 at «http://www.beautyandgashiontech.com/2010/01/loreal-true-match-roller-foundation.html», 8 pages.
(Continued)

*Primary Examiner* — Jennifer C Chiang
*Assistant Examiner* — Bradley Oliver
(74) *Attorney, Agent, or Firm* — Seager, Tufte & Wickhem LLP

(57) ABSTRACT

A quick release container includes a base having a well to hold a product and a neck including latches each having a latch protrusion and a flexible portion. The quick release container includes a lid assembly having an inner lid portion and an outer lid portion movable relative to each other. One or more first lid protrusions prevent movement of the outer lid portion. The lid assembly includes a biasing element to apply a biasing force to the outer lid portion. The lid assembly includes a collar that moves between the outer lid portion and the base. The collar has one or more collar protrusions each configured to engage the flexible portions of the one or more latches and cause the one or more latch protrusions to disengage from the one or more first lid protrusions and facilitate movement of the outer lid portion relative to the inner lid portion.

19 Claims, 8 Drawing Sheets

(56) References Cited

U.S. PATENT DOCUMENTS

| | | | |
|---|---|---|---|
| 776,468 | A | 11/1904 | Hosmer |
| 1,030,440 | A | 6/1912 | Waterman |
| 1,065,879 | A | 6/1913 | Krebs |
| 1,067,596 | A | 7/1913 | Fesler |
| 1,112,193 | A | 9/1914 | Carleton et al. |
| 1,156,456 | A | 10/1915 | Beck |
| 1,170,923 | A | 2/1916 | Malkin |
| 1,188,214 | A | 6/1916 | Sohn |
| 1,274,697 | A | 8/1918 | Dynowsky |
| 1,355,026 | A | 10/1920 | Austin |
| 1,357,306 | A | 11/1920 | Aste |
| 1,358,597 | A | 11/1920 | Leon |
| 1,365,246 | A | 1/1921 | Kendall |
| 1,462,034 | A | 7/1923 | Finlayson |
| 1,506,292 | A | 8/1924 | Corsello |
| 1,616,381 | A | 2/1927 | Macdougall |
| 1,620,002 | A | 3/1927 | Barany |
| 1,626,992 | A | 5/1927 | Willk |
| 1,639,388 | A | 8/1927 | Stebbings |
| 1,642,780 | A | 9/1927 | Kole et al. |
| 1,659,800 | A | 2/1928 | Bailey |
| 1,668,658 | A | 5/1928 | Reutter |
| 1,709,445 | A | 4/1929 | Tomes |
| 2,055,389 | A | 9/1936 | Rosenberg |
| D104,300 | S | 4/1937 | Wolfsheim |
| 2,321,265 | A | 6/1943 | Ulvick |
| D156,948 | S | 1/1950 | Fisher |
| 2,518,382 | A | 8/1950 | Ruthsatz |
| 2,697,642 | A | 12/1954 | Rudy |
| 2,701,659 | A | 2/1955 | Baltosser |
| 2,725,038 | A | 11/1955 | Morris |
| 2,816,308 | A | 12/1957 | Schultz |
| 2,817,451 | A | 12/1957 | Giles et al. |
| 2,825,080 | A | 3/1958 | Bongiovanni |
| 2,866,993 | A | 1/1959 | Edelstone |
| 2,976,897 | A | 3/1961 | Beckworth |
| 2,990,086 | A | 6/1961 | Williams |
| 3,028,868 | A | 4/1962 | Tandler, Jr. |
| 3,039,132 | A | 6/1962 | Colman |
| 3,095,598 | A | 7/1963 | Gonnella et al. |
| 3,100,589 | A | 8/1963 | Love, Jr. |
| 3,111,736 | A | 11/1963 | Budreck |
| 3,235,900 | A | 2/1966 | Klassen |
| D204,449 | S | 4/1966 | Zavodsky |
| 3,256,550 | A | 6/1966 | Laxalt |
| 3,259,935 | A | 7/1966 | Miller |
| 3,276,642 | A | 10/1966 | Johnson, Jr. |
| 3,282,473 | A | 11/1966 | Moore |
| 3,342,379 | A | 9/1967 | Foley |
| D209,098 | S | 10/1967 | Spiess |
| 3,363,775 | A | 1/1968 | Shaw |
| 3,536,333 | A | 10/1970 | Gits et al. |
| 3,552,402 | A | 1/1971 | Levy |
| 3,729,011 | A | 4/1973 | Gleicher |
| 3,734,106 | A | 5/1973 | Zimmerman |
| D230,137 | S | 1/1974 | Bettonica |
| 3,837,749 | A | 9/1974 | Spatz |
| 3,850,183 | A | 11/1974 | Gruska |
| D239,160 | S | 3/1976 | Giberstein |
| D245,398 | S | 8/1977 | Grodin |
| 4,129,391 | A | 12/1978 | Gamacher et al. |
| 4,147,284 | A | 4/1979 | Mizzi et al. |
| 4,159,789 | A | 7/1979 | Stoody et al. |
| 4,165,755 | A | 8/1979 | Cassai |
| 4,224,958 | A | 9/1980 | Kaplan et al. |
| 4,310,108 | A | 1/1982 | Motoyama et al. |
| D268,097 | S | 3/1983 | Thompson |
| 4,428,388 | A | 1/1984 | Cassai et al. |
| 4,441,629 | A | 4/1984 | Mackal |
| 4,446,880 | A | 5/1984 | Gueret et al. |
| 4,456,155 | A | 6/1984 | Miyata et al. |
| D281,281 | S | 11/1985 | Matalon |
| 4,626,119 | A | 12/1986 | Ladd, Jr. et al. |
| 4,630,954 | A | 12/1986 | Ladd, Jr. et al. |
| 4,630,955 | A | 12/1986 | Ladd, Jr. et al. |
| 4,647,240 | A | 3/1987 | Ladd, Jr. et al. |
| 4,648,732 | A | 3/1987 | Smialkowski |
| 4,652,162 | A | 3/1987 | Ladd, Jr. et al. |
| 4,671,431 | A | 6/1987 | Obrist |
| 4,671,690 | A | 6/1987 | Ladd, Jr. et al. |
| 4,674,537 | A | 6/1987 | Bergmann |
| 4,681,127 | A | 7/1987 | Gueret |
| 4,696,317 | A | 9/1987 | Shioi et al. |
| 4,728,211 | A | 3/1988 | Ladd, Jr. et al. |
| D303,927 | S | 10/1989 | Weber |
| 4,877,157 | A | 10/1989 | Saulle |
| 4,888,668 | A | 12/1989 | Roll |
| 4,906,120 | A | 3/1990 | Sekiguchi et al. |
| 4,909,265 | A | 3/1990 | Goncalves |
| 4,927,281 | A | 5/1990 | Gueret et al. |
| 4,940,350 | A | 7/1990 | Kim et al. |
| D317,407 | S | 6/1991 | Gray et al. |
| D319,105 | S | 8/1991 | Cheng |
| 5,050,276 | A | 9/1991 | Pemberton |
| 5,063,947 | A | 11/1991 | Gueret et al. |
| D324,994 | S | 3/1992 | Jentgen |
| 5,107,871 | A | 4/1992 | Butcher et al. |
| 5,107,984 | A | 4/1992 | Welschoff |
| 5,116,156 | A | 5/1992 | Landi |
| 5,137,038 | A | 8/1992 | Kingsford et al. |
| 5,165,760 | A | 11/1992 | Gueret et al. |
| D337,207 | S | 7/1993 | Tiramani et al. |
| 5,301,838 | A | 4/1994 | Schmidt et al. |
| 5,302,043 | A | 4/1994 | Velliquette et al. |
| 5,328,282 | A | 7/1994 | Charrier et al. |
| 5,339,483 | A | 8/1994 | Byun et al. |
| D350,836 | S | 9/1994 | Chevassus |
| D355,363 | S | 2/1995 | Iorii et al. |
| 5,482,059 | A | 1/1996 | Miraglia |
| 5,514,135 | A | 5/1996 | Earle |
| 5,515,876 | A | 5/1996 | Warner et al. |
| 5,535,925 | A | 7/1996 | Hinden et al. |
| 5,570,813 | A | 11/1996 | Clark, II |
| 5,598,929 | A | 2/1997 | Jensen et al. |
| D389,064 | S | 1/1998 | Sethi et al. |
| 5,704,378 | A | 1/1998 | Machelett |
| 5,769,234 | A | 6/1998 | Gueret |
| D400,009 | S | 10/1998 | Conway |
| 5,836,320 | A | 11/1998 | Gueret et al. |
| D405,684 | S | 2/1999 | Gager et al. |
| D408,626 | S | 4/1999 | Lage |
| D411,749 | S | 6/1999 | Nahum-Albright |
| 5,913,631 | A | 6/1999 | Landry |
| 5,934,815 | A | 8/1999 | Hurlburt |
| 5,934,816 | A | 8/1999 | Bruttomesso |
| 5,950,638 | A | 9/1999 | Crosota |
| D416,491 | S | 11/1999 | Gobe |
| 5,975,368 | A | 11/1999 | Wood |
| 5,988,185 | A | 11/1999 | Gueret et al. |
| 5,992,423 | A | 11/1999 | Tevolini |
| D417,752 | S | 12/1999 | Bakic |
| D418,253 | S | 12/1999 | Bakic |
| 6,010,264 | A | 1/2000 | Scuderi et al. |
| D419,865 | S | 2/2000 | Gager et al. |
| 6,035,865 | A | 3/2000 | Krieger |
| D422,139 | S | 4/2000 | Meikle |
| 6,053,183 | A | 4/2000 | Rizzo |
| 6,070,597 | A | 6/2000 | Motherhead |
| D427,424 | S | 7/2000 | Conway |
| D429,424 | S | 8/2000 | Vanderminden, Sr. |
| D432,784 | S | 10/2000 | Conway |
| D433,189 | S | 10/2000 | Schoon et al. |
| 6,126,352 | A | 10/2000 | Wiley et al. |
| 6,138,687 | A | 10/2000 | Sheffler et al. |
| D433,537 | S | 11/2000 | Schoon et al. |
| D434,187 | S | 11/2000 | Schoon et al. |
| 6,142,695 | A | 11/2000 | Byun |
| 6,145,514 | A | 11/2000 | Clay et al. |
| 6,149,008 | A | 11/2000 | Yuhara |
| D436,434 | S | 1/2001 | Conway |
| 6,173,719 | B1 | 1/2001 | Petit |
| 6,189,697 | B1 | 2/2001 | Davis |
| 6,224,287 | B1 | 5/2001 | Gieux |
| D447,694 | S | 9/2001 | Leggett |

(56) References Cited

U.S. PATENT DOCUMENTS

| | | | |
|---|---|---|---|
| 6,283,172 | B1 | 9/2001 | Thurner |
| 6,283,298 | B1 | 9/2001 | Seidler |
| 6,309,124 | B1 | 10/2001 | Gueret |
| 6,309,125 | B1 | 10/2001 | Peters |
| 6,311,701 | B1 | 11/2001 | Yuhara et al. |
| 6,332,482 | B1 | 12/2001 | Runge et al. |
| 6,336,460 | B2 | 1/2002 | Yuhara |
| 6,363,948 | B2 | 4/2002 | Choi |
| 6,367,799 | B1 | 4/2002 | Sippel |
| 6,418,939 | B1 | 7/2002 | Byun |
| D468,423 | S | 1/2003 | Renfrew |
| D470,415 | S | 2/2003 | Weber |
| 6,532,970 | B2 | 3/2003 | Phue |
| 6,546,937 | B2 | 4/2003 | Gueret |
| 6,588,958 | B1 | 7/2003 | Seidler |
| 6,591,842 | B2 | 7/2003 | Gueret |
| 6,592,054 | B2 | 7/2003 | Prus |
| D483,418 | S | 12/2003 | Carr et al. |
| 6,669,389 | B2 | 12/2003 | Gueret |
| 6,672,784 | B2 | 1/2004 | Baumann et al. |
| 6,681,936 | B2 | 1/2004 | Godshaw et al. |
| 6,758,374 | B2 | 7/2004 | Albisetti |
| 6,769,572 | B1 | 8/2004 | Cullotta |
| 6,789,974 | B2 | 9/2004 | Atkinson et al. |
| 6,793,431 | B1 | 9/2004 | Tsai |
| 6,831,541 | B1 | 12/2004 | Seidler |
| 6,866,046 | B2 | 3/2005 | Gueret |
| 6,926,151 | B1 | 8/2005 | Perry et al. |
| 6,929,159 | B1 | 8/2005 | Haig |
| 6,935,541 | B1 | 8/2005 | Campbell et al. |
| 6,935,802 | B1 | 8/2005 | Byun |
| 6,945,403 | B2 | 9/2005 | Lombardi |
| 6,974,513 | B2 | 12/2005 | Kepka |
| 7,028,843 | B2 | 4/2006 | Byun |
| D526,121 | S | 8/2006 | Nip |
| D527,180 | S | 8/2006 | Raile |
| 7,100,806 | B2 | 9/2006 | Schuster et al. |
| 7,101,107 | B1 | 9/2006 | Byun |
| 7,108,441 | B2 | 9/2006 | Altonen et al. |
| 7,118,298 | B2 | 10/2006 | Tsutsumi |
| D532,637 | S | 11/2006 | Bassett et al. |
| 7,163,130 | B2 | 1/2007 | Lafond |
| D537,180 | S | 2/2007 | Hsu |
| 7,188,753 | B2 | 3/2007 | Campbell |
| 7,234,474 | B2 | 6/2007 | Byun |
| 7,237,973 | B1 | 7/2007 | Lou |
| D553,355 | S | 10/2007 | Mosteller |
| 7,316,235 | B2 | 1/2008 | Maio et al. |
| 7,334,709 | B1 | 2/2008 | Huang |
| 7,344,327 | B2 | 3/2008 | Gueret |
| D572,476 | S | 7/2008 | Raile |
| 7,419,323 | B1 | 9/2008 | Zhang |
| 7,429,141 | B2 | 9/2008 | Habatjou |
| 7,461,993 | B1 | 12/2008 | Sampaio |
| 7,467,905 | B2 | 12/2008 | Habatjou |
| 7,494,030 | B2 | 2/2009 | Bennett |
| 7,524,125 | B2 | 4/2009 | Lambert |
| D594,320 | S | 6/2009 | Tanaka et al. |
| D598,655 | S | 8/2009 | Thorpe et al. |
| 7,628,559 | B2 | 12/2009 | Petit |
| D608,205 | S | 1/2010 | Bartholomeu et al. |
| 7,677,827 | B1 | 3/2010 | Manukian |
| D620,808 | S | 8/2010 | Gieux |
| 7,775,737 | B2 | 8/2010 | Deans et al. |
| 7,794,168 | B2 | 9/2010 | Chang |
| 7,854,562 | B2 | 12/2010 | Peterson et al. |
| D631,192 | S | 1/2011 | Lim |
| 7,866,758 | B2 | 1/2011 | Jang |
| 7,878,727 | B2 | 2/2011 | Koptis |
| 7,918,620 | B2 | 4/2011 | Del Ponte |
| D639,664 | S | 6/2011 | Thorpe et al. |
| D643,294 | S | 8/2011 | Thorpe et al. |
| 8,006,707 | B2 | 8/2011 | Thorpe et al. |
| 8,025,067 | B2 | 9/2011 | Thorpe et al. |
| 8,118,040 | B2 | 2/2012 | Bennett |
| 8,132,578 | B2 | 3/2012 | LoPrete |
| 8,210,187 | B1 | 7/2012 | Zhang |
| 8,286,648 | B2 | 10/2012 | Thorpe et al. |
| 8,292,535 | B2 | 10/2012 | Thorpe |
| 8,387,627 | B2 | 3/2013 | Yeom |
| 8,499,970 | B2 | 8/2013 | Yoo |
| 8,517,622 | B2 | 8/2013 | Apodaca et al. |
| 8,540,449 | B2 | 9/2013 | Song |
| 8,678,222 | B2 | 3/2014 | Thorpe et al. |
| 8,714,857 | B1 | 5/2014 | Liu |
| 8,839,803 | B2 | 9/2014 | Holloway |
| 9,016,600 | B2 | 4/2015 | Pearson et al. |
| 9,016,968 | B2 | 4/2015 | Thorpe |
| 2001/0037815 | A1 | 11/2001 | Gueret |
| 2002/0014246 | A1 | 2/2002 | Choi |
| 2002/0040720 | A1 | 4/2002 | Byun |
| 2002/0056660 | A1 | 5/2002 | Gueret |
| 2002/0117423 | A1 | 8/2002 | Jackson |
| 2003/0024545 | A1 | 2/2003 | Delage |
| 2003/0154997 | A1 | 8/2003 | Lin |
| 2004/0018037 | A1 | 1/2004 | Dorf |
| 2004/0089318 | A1 | 5/2004 | Tahara |
| 2004/0114988 | A1 | 6/2004 | Baumann et al. |
| 2004/0120753 | A1 | 6/2004 | Gieux |
| 2004/0129284 | A1 | 7/2004 | Abergel |
| 2004/0168700 | A1 | 9/2004 | Dorf |
| 2004/0250833 | A1 | 12/2004 | Jang |
| 2005/0011895 | A1 | 1/2005 | Lin |
| 2005/0031401 | A1 | 2/2005 | Gueret |
| 2005/0224392 | A1 | 10/2005 | Perry et al. |
| 2005/0247740 | A1 | 11/2005 | Puzio |
| 2005/0249539 | A1 | 11/2005 | Habatjou |
| 2005/0286967 | A1 | 12/2005 | Blauzdys |
| 2006/0026783 | A1 | 2/2006 | McKay |
| 2006/0097011 | A1 | 5/2006 | Kou |
| 2006/0186019 | A1 | 8/2006 | Lu |
| 2006/0222451 | A1 | 10/2006 | Glassman |
| 2006/0278665 | A1 | 12/2006 | Bennett |
| 2007/0014624 | A1 | 1/2007 | Fogelson et al. |
| 2007/0071538 | A1 | 3/2007 | Doria |
| 2007/0084885 | A1 | 4/2007 | Conway et al. |
| 2007/0098485 | A1 | 5/2007 | Byun |
| 2007/0158372 | A1 | 7/2007 | Kurek et al. |
| 2007/0187284 | A1 | 8/2007 | Goto et al. |
| 2007/0199575 | A1 | 8/2007 | Del Ponte |
| 2007/0205233 | A1 | 9/2007 | Petit et al. |
| 2007/0228079 | A1 | 10/2007 | Vogel et al. |
| 2007/0235471 | A1 | 10/2007 | Radermacher |
| 2008/0011320 | A1 | 1/2008 | Bouix et al. |
| 2008/0178903 | A1 | 7/2008 | Thorpe et al. |
| 2008/0264440 | A1 | 10/2008 | Thorpe |
| 2008/0273914 | A1 | 11/2008 | Hamada |
| 2008/0283083 | A1 | 11/2008 | Piao |
| 2009/0162131 | A1 | 6/2009 | Thorpe et al. |
| 2009/0183328 | A1 | 7/2009 | King |
| 2009/0188518 | A1 | 7/2009 | Thorpe et al. |
| 2009/0194120 | A1 | 8/2009 | Pires et al. |
| 2009/0194127 | A1 | 8/2009 | Pires et al. |
| 2009/0205673 | A1 | 8/2009 | Richardson |
| 2009/0272400 | A1 | 11/2009 | Park et al. |
| 2010/0017990 | A1 | 1/2010 | Piao |
| 2010/0028070 | A1 | 2/2010 | Gieux et al. |
| 2010/0037407 | A1 | 2/2010 | Telwar |
| 2010/0054844 | A1 | 3/2010 | Thorpe |
| 2010/0119290 | A1 | 5/2010 | Thorpe et al. |
| 2010/0236004 | A1 | 9/2010 | Xu |
| 2011/0250008 | A1 | 10/2011 | Lim |
| 2011/0253166 | A1 | 10/2011 | Lin |
| 2012/0267390 | A1 | 10/2012 | Jeong et al. |
| 2012/0279876 | A1 | 11/2012 | Weigel |
| 2013/0068801 | A1 | 3/2013 | Lai |
| 2013/0087165 | A1 | 4/2013 | Lee et al. |
| 2013/0108350 | A1 | 5/2013 | Ulrich et al. |
| 2013/0161345 | A1 | 6/2013 | Tatin |

(56) References Cited

U.S. PATENT DOCUMENTS

| | | | | |
|---|---|---|---|---|
| 2013/0343798 | A1* | 12/2013 | Delage ..... | A45D 40/0068 401/81 |
| 2014/0145011 | A1 | 5/2014 | Brand et al. | |

FOREIGN PATENT DOCUMENTS

| | | | |
|---|---|---|---|
| CN | 201067174 | Y | 6/2008 |
| CN | 201131422 | Y | 10/2008 |
| CN | 101884463 | A | 11/2010 |
| DE | 10038850 | A1 | 2/2002 |
| DE | 202008002070 | U1 | 5/2008 |
| EP | 1195106 | A1 | 4/2002 |
| EP | 2084986 | A2 | 8/2009 |
| EP | 2301379 | A1 | 3/2011 |
| FR | 2911766 | A1 | 8/2008 |
| GB | 798044 | A | 7/1958 |
| GB | 2404370 | A | 2/2005 |
| GB | 2446039 | A | 7/2008 |
| GB | 2463086 | A1 | 3/2010 |
| JP | 57018414 | A | 1/1982 |
| JP | 556487 | U | 7/1993 |
| JP | 9056462 | A | 3/1997 |
| JP | 3051335 | U1 | 6/1998 |
| JP | 10249253 | A | 9/1998 |
| JP | 2000254575 | A | 9/2000 |
| JP | 2001190327 | A | 7/2001 |
| JP | 2002059044 | A | 2/2002 |
| JP | 2002306236 | A | 10/2002 |
| JP | 2003033228 | A | 2/2003 |
| JP | 2004222853 | A | 8/2004 |
| JP | 2005121103 | A | 5/2005 |
| JP | 2006312083 | A | 11/2006 |
| JP | 2007068945 | A | 3/2007 |
| JP | 2008309807 | A | 5/2010 |
| JP | 2010110598 | A | 5/2010 |
| KR | 200322309 | Y1 | 8/2003 |
| KR | 200432010 | Y1 | 11/2006 |
| KR | 20090004125 | A | 1/2009 |
| KR | 20090104593 | A | 10/2009 |
| WO | 9211785 | A1 | 7/1992 |
| WO | 0210029 | A1 | 2/2002 |
| WO | 2006101339 | A1 | 9/2006 |
| WO | 2007117091 | A1 | 10/2007 |
| WO | 2010098997 | A1 | 9/2010 |
| WO | 2012071376 | A2 | 5/2012 |

OTHER PUBLICATIONS

CN 3203451, Registered Industrial Design Application (Tianjin Samsun Brushes Ltd.) Oct. 10, 2001.

CN 3401674, Registered Industrail Design Application (Tianhin Samsung Brushed Ltd.), Nov. 3, 2204.

"Givenchy Demesure Audacious Lashes Mascara", May 17, 2011, retrieved from the internet at «http://www.fashionizers.com/perfumes-makeuo/givenchy-demesure-audacious-lashes-mascarar/», 9 pages.

"Color Wonder Airbrush", Crayola, retrieved on Feb. 20, 2014 at «http://shop.crayola.com/art-and-craft-supplies/mess-free-coloring/color-wonder-airbrush-7522190000.html», 2 pages.

"Marker Airbrush", Crayola, retrieved on Feb. 20, 2015 at «http://shop.crayola.com/toys/creative-activites/marker-airbrush-0487270001.html», 2 pages.

Sure Shot Milwaukee Sprayer, retrieved from http://www.sureshotsprayer.com/AtomizersSprayers.html on Jan. 7, 2014; 2 pages.

PCT Appl. No. US2015/050961, The International Search Report and the Written Opinion of the International Searching Authority, dated Dec. 28, 2015.

* cited by examiner

CONTAINER WITH QUICK RELEASE BASE AND LID ASSEMBLY

RELATED APPLICATIONS

This application claims priority to U.S. Provisional Application No. 62/052,101, filed Sep. 18, 2014.

TECHNOLOGY FIELD

The present application relates generally to a container with a base and lid assembly, and in particular, to a container having a quick release base and lid assembly. In particular embodiments, the container having a quick release base and lid assembly are containers adapted for cosmetics, such as mascara, lip gloss, and the like.

BACKGROUND

Vessels or containers exist that are portable, convenient to use, and designed to contain volatile and/or aggressive products for use. These types of portable vessels usually consist of a base assembly and a lid assembly, that when assembled together provide an effective barrier for containing the volatile product. The base and/or lid are typically made of a glass, a plastic, a metal, combinations of the foregoing, or the like.

Such vessels are used in the cosmetics and personal care industries for containing a product to be applied to a body, where, as described above, the product to be applied to the body may be volatile and/or aggressive product. Conventional base and lid assemblies may be opened and closed using different types of mechanisms. For example, conventional base and lid assemblies are opened and closed using rotatable thread mechanisms, snap mechanisms, and clamp mechanisms. Although portable vessels exist, there is a continuing need for more and different vessels and fastening mechanisms.

SUMMARY

Embodiments provide a quick release container that includes a base having a well configured to hold a product and a neck coupled to the base. The neck includes one or more latches each having: (i) a latch protrusion extending from the neck; and (ii) a flexible portion. The quick release container also includes a lid assembly. The lid assembly includes an inner lid portion removably coupled to the neck and an outer lid portion configured to at least partially house the inner lid portion and configured to be movable relative to the inner lid portion. The outer lid portion has one or more first lid protrusions configured to movement of the outer lid portion in a first direction relative to the inner lid portion when the one or more first lid protrusions are engaged with one or more of the latch protrusions. The lid assembly also includes a biasing element coupled between the inner lid portion and the outer lid portion and configured to apply a biasing force to the outer lid portion in the first direction. The lid assembly further includes a collar at least partially housing the neck and configured to move between the outer lid portion and the base in the first direction. The collar has one or more collar protrusions each configured to engage the flexible portions of the one or more latches and cause the one or more latch protrusions to disengage from the one or more first lid protrusions and facilitate movement of the outer lid portion in the first direction relative to the inner lid portion.

According to an embodiment, the one or more latches are configured to flex from corresponding original latch positions when the one or more collar protrusions are moved from an original collar position along the flexible portions of the one or more latches. The one or more latches disengage from the one or more first lid protrusions when the one or more latches flex from their corresponding original latch positions.

According to another embodiment, the collar is further configured to move in a second direction opposite the first direction and the one or more latches are configured to deflex and return to their corresponding original positions when the collar moves in the second direction.

In one embodiment, the neck includes an opening providing access to the well of the base. The quick release container further includes a brush stem extending front the inner lid portion into the well through the opening of the neck and the brush stem is configured to be removed from the well when the lid assembly is removed from the container.

In an aspect of an embodiment, the container further includes an applicator coupled to a distal end of the brush stem.

In another aspect of an embodiment, the brush is fixed to the neck.

According to one embodiment, the inner lid portion and the brush stem are unitary. In another embodiment, the inner lid portion and the brush stem are separate elements that are coupled together.

In one embodiment, the flexible portion includes a sloped portion. The one or more collar protrusions are each configured to move along the sloped portion of the one or more latches and cause the one or more latch protrusions to disengage from the one or more first lid protrusions and facilitate movement of the outer lid portion in the first direction relative to the inner lid portion.

In an aspect of an embodiment, the biasing element is a spring.

According to one embodiment, the collar is convex shaped to receive one or more fingers of a user and facilitate movement of the collar in the first direction or the second direction.

According to another embodiment, the inner lid portion comprises one or more inner lid protrusions extending away from an outer circumference of the inner lid portion. The outer lid portion further comprises one or more second lid protrusions extending away from an inner circumference of the outer lid and spaced from the one or more second lid protrusions. The one or more second lid protrusions of the outer lid are configured to move along the outer surface of the inner lid portion in the first direction when the outer lid portion moves in the first direction. The one or more inner lid protrusions are configured to prevent further movement of the outer lid portion in the first direction when the one or more inner lid protrusions contact the one or more corresponding second lid protrusions.

Embodiments provide a quick release container that includes a base having a well configured to hold a product and a neck coupled to the base, the neck comprising one or more latches and a lid assembly. The lid assembly includes an inner lid portion, a brush stem extending from the inner lid portion into the well through an opening in the neck and an outer lid portion configured to be movable relative to the inner lid portion. The lid assembly also includes a biasing element coupled between the inner lid portion and the outer lid portion and configured to apply a biasing force to the outer lid portion to move the outer lid portion away from the inner lid portion. The lid assembly also includes a collar comprising one or inure collar protrusions configured to engage a flexible portion of the one or more latches and cause the one or more latches to move away from and disengage from one or more corresponding first lid protrusions on an inner surface of the outer lid portion to facilitate the movement of the outer lid portion away from the inner lid portion.

According to one embodiment, the one or more corresponding first lid protrusions are configured to prevent movement of the outer lid portion in the first direction relative to the inner lid portion when the one or more first lid protrusions are engaged with one or more latch protrusions.

According to another embodiment, the flexible portion includes a sloped portion, and the one or more collar protrusions are configured to move along a sloped portion of the one or more latches in a direction away from the outer lid portion and toward the base.

In another embodiment, the one or more latch protrusions comprise a plurality of latch protrusions spaced from each other around an outer circumference of the neck.

Embodiments provide a container that includes a base portion defining a well for housing the cosmetic and the base portion further defining an opening for facilitating removal of the cosmetic, a lid portion for closing the opening in the base portion and a quick release mechanism selectively and removably coupling the lid portion to a base portion.

According to one embodiment, the quick release mechanism includes a plurality of mated latching mechanisms disposed about the circumference of the container and a circumferential collar. The circumferential collar is selectively displaceable to engage or disengage the plurality of mated latching mechanisms corresponding to a latched and unlatched position.

According to another embodiment, the circumferential collar is biased in the locked position.

In an aspect of an embodiment, the circumferential collar is of the base portion for displacement thereon between latched and unlatched positions.

In yet another embodiment, the lid of the container is further provided with an applicator stem.

BRIEF DESCRIPTION OF THE DRAWINGS

The foregoing and other aspects of the container with quick release base and lid assembly are best understood from the following detailed description when read in connection with the accompanying drawings. There are shown in the drawings embodiments that are presently preferred, it being understood, however, that the disclosure is not limited to the specific instrumentalities disclosed. Included in the drawings are the following Figures.

DETAILED DESCRIPTION

"Quick release mechanism" as used herein encompasses latching mechanisms that are readily disengagable through a simple movement, such as sliding, twisting, or pushing one or more elements with respect to another which causes one or more mated latching elements to disengage from one another to facilitate removal of a lid from a base. Quick release mechanism is not to be interpreted to include simple friction fit, screw top, or simple hinge-lid mechanisms.

Figure 1:
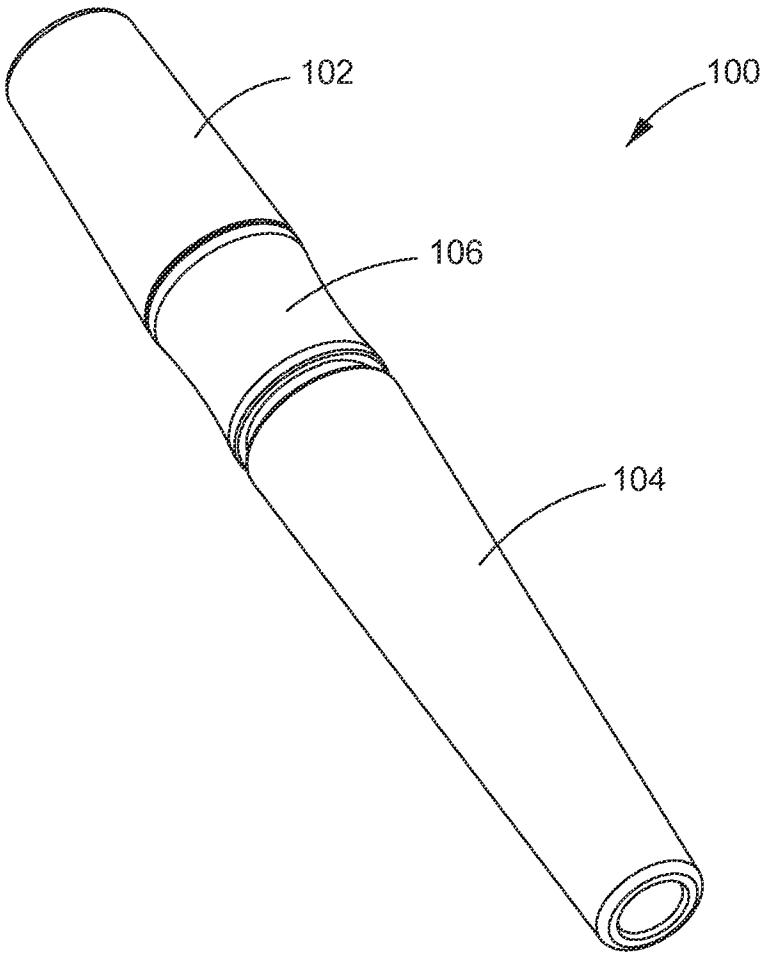
FIG. 1 is a perspective view of an exemplary quick release container in a closed position according to embodiments disclosed herein.

FIG. 1 is a perspective view of a quick release container 100 in a closed position according to embodiments disclosed herein. As shown in FIG. 1, quick release container 100 may include lid assembly 102, base assembly 104 and collar 106, The size and shape of the quick release container 100 and each portion of the quick release container 100 shown in FIG. 1 is merely exemplary. Embodiments may include quick release containers having other shapes and sizes. As shown and described herein for convenience, the quick release container is an elongated container suitable for containers including stem applicators, such as those for use with mascara, lip gloss, and the like.

Figure 2B:
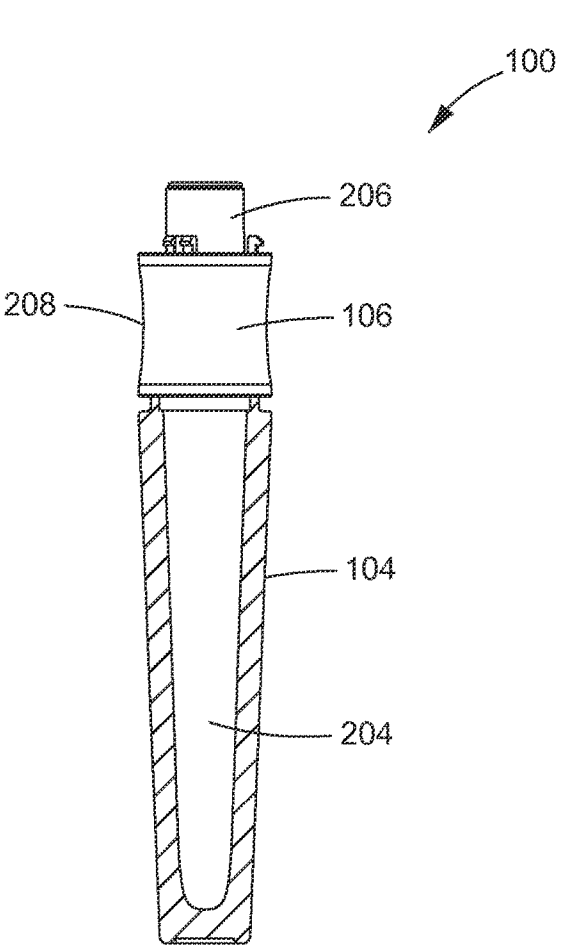
FIG. 2B is a partial cut-away side view of the exemplary quick release container with the lid and stem assembly removed according to embodiments disclosed herein.
Figure 2A:
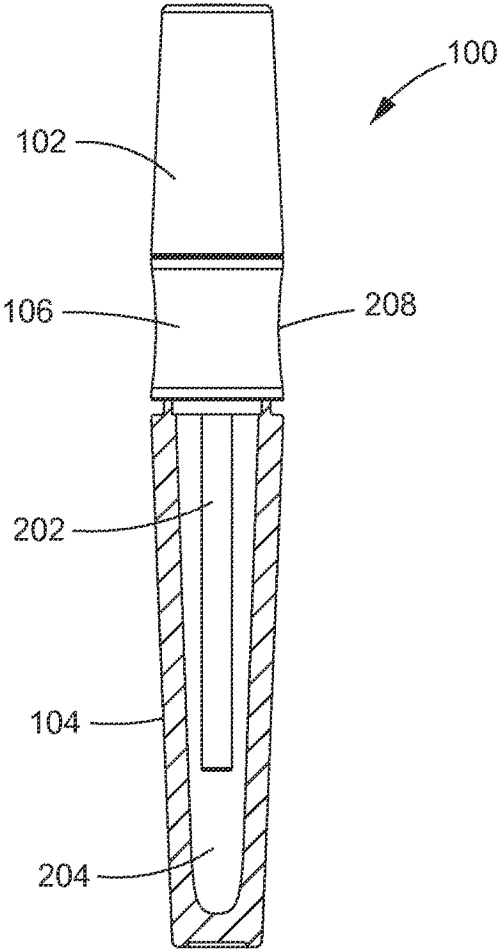
FIG. 2A is a partial cut-away side view of an exemplary quick release container in a closed position according to embodiments disclosed herein.

FIG. 2A is a partial cross sectional side view of exemplary quick release container 100 in a closed position according to embodiments disclosed herein. FIG. 2B is a partial cross sectional side view of the exemplary quick release container 100 with the lid assembly removed according to embodiments disclosed herein. As shown in FIG. 2A, lid assembly 102 may include a stem 202 extending into a well 204 defined by base 104 when the quick release container 100 is in the closed position. Throughout the figures, the stem 202 is shown without any applicator at its distal end. It will be appreciated by those of skill in the art that any type of applicator may be present. In cosmetics, any suitable applicator may be employed, including but not limited to a brush, a doefoot, a sponge, bristles, a comb, mascara fiber brush, mascara TPE brush, a dropper, etc. Any of these elements may be made of various materials including plastics, metals and ceramics, etc. In some embodiments, applicators and/or stems may be fixed to portions (e.g., top portions) of the necks. In other embodiments, applicators and/or stems may be removably coupled to portions (e.g., top portions) of the necks.

The well 204 is configured to hold product, such as cosmetics, for example, mascara, lip gloss, nail polish, foundation, concealer, skincare, eye care solutions, etc. Product has been omitted from the figures for clarity. As shown in FIG. 2B, when lid assembly 102 is removed from base 104, stem 202 is removed from well 204 (configured to hold a product not shown) of base 104, exposing a portion of neck 206 that extends from collar 106. The size and shape of stem 202 shown in FIG. 2A is merely exemplary. Embodiments may include quick release containers having stems of other shapes and sizes.

Some embodiments may include lid assemblies without a stem (e.g., where the applicator protrudes from the neck 206 itself).

As shown in FIG. 23, the outer circumferential surface 208 of collar 106 may be configured to receive one or more fingers of a user to facilitate movement (as described in detail below) of collar 106 and provide the quick release of lid assembly 102 from base 104. As depicted, outer circumferential surface 208 has a convex curvature. One of skill in the art will recognize any shape or contour may be used. The size and shape of collar 106 shown in FIG. 2A and FIG. 2B are merely exemplary. Embodiments may include quick release containers having collars of other shapes and sizes, including other shapes and sizes configured to facilitate the quick release of lid assemblies from bases. In some embodiments, collars may include various textures and finishes to facilitate gripping the collar 106.

Exemplary quick release containers may be used to hold any type of product, but may be particularly well suited for cosmetics that may include, but are not limited to, loose powders (e.g., for eye, cheek, face, and the like), creams (e.g., skincare, eye, foundation, and the like), sunscreen, hot pour products (e.g., lipsticks, glosses, and the like), touchup, spot cover. baked powders, moisturizers, hair creams, gels, serums, and the like.

Figure 3:
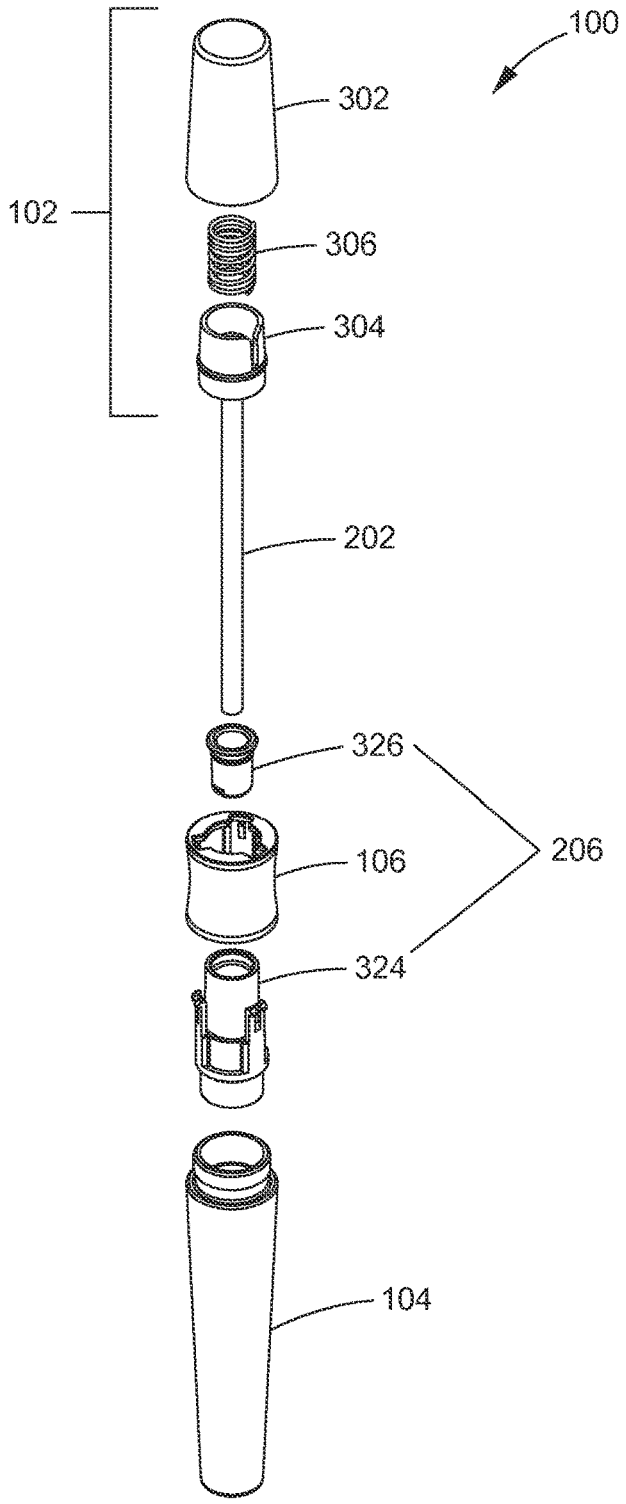
FIG. 3 is an exploded, perspective view of an exemplary quick release container according to embodiments disclosed herein.

FIG. 3 is an exploded view of an exemplary quick release container 100 according to embodiments disclosed herein. As shown in FIG. 3, lid assembly 102 may include an outer lid portion 302 and an inner lid portion 304. As shown in FIGS, 6C through 6E, outer lid portion 302 may be configured to move relative to inner lid portion 304 in the direction of arrows 602 and 604.

Referring to FIG. 3, neck 206 of quick release container 100 may include an inner neck portion 326 and an outer neck portion 324. The inner neck portion 326 may define a wiper for controlling the amount of product on the stem 202 and applicator (not shown). Wipers are well known and typically are made of a resilient material such as rubber or silicone. Quick release container 100 may also include collar 106 and base 104. As shown in FIG. 3, lid assembly 102 may also include stem 202. As illustrated in the embodiments in FIG. 6A through FIG. 6E, inner lid portion 304 may be unitary with the stem 202. In other embodiments, however, inner lid portion 304 and stem 202 may be separate elements that are coupled together.

Lid assembly 102 may also include biasing element (e.g., spring) 306 configured to provide a biasing force to facilitate the quick release of lid assembly 102 from base 104. The size and shape of spring 306 shown throughout is merely exemplary. Embodiments may include springs of different shapes and sizes. Embodiments may also include biasing elements other than springs configured to provide a biasing three to facilitate the quick release of lid assemblies from bases.

As shown in FIG. 6A through 6E, outer lid portion 302, may include upper lid protrusions 308 and lower lid protrusions 310. The size, shape, and location of upper lid protrusion 308 and lower lid protrusion 310 shown in FIG. 6A through 6E are merely exemplary. Embodiments may also include any number of upper lid protrusions and lower lid protrusions each having other shapes or sizes. Some embodiments may include a continuous upper lid protrusion 308 and/or lower lid protrusion 310 that extends around an inner circumference of the outer lid portion 302.

Inner lid portion 304 may include inner lid protrusion 305. The size, shape, and location of inner lid protrusion 305 shown in FIGS. 6A through 6E is merely exemplary. Embodiments may also include any number of inner lid protrusions and lower lid protrusions each having other shapes or sizes. Some embodiments may include a continuous inner lid protrusion 305 that extends around an outer circumference of the inner lid portion 304.

Figure 4:
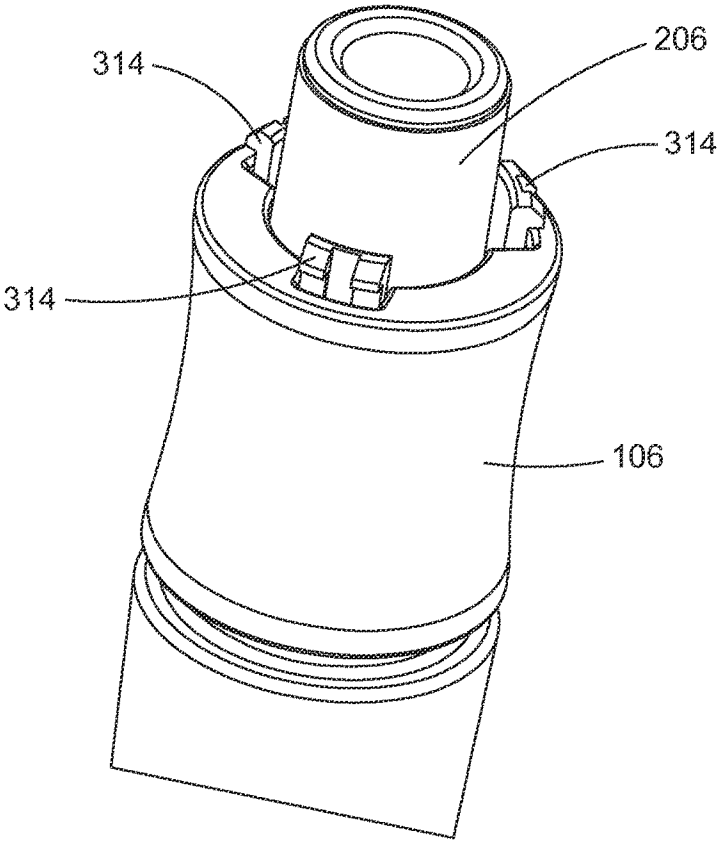
FIG. 4 is a close-up, perspective view of an exemplary quick release container with the lid assembly removed illustrating the neck and collar according to embodiments disclosed herein.

FIG. 4 is a close-up perspective view of the exemplary quick release container 100 shown in FIG. 1 with the lid assembly 102 removed illustrating the neck 206 extending through and beyond collar 106 according to embodiments disclosed herein. As shown in FIG. 4, neck 206 may include three neck latches 314. The size, shape, location and number of latches 314 shown in FIG. 4 and throughout, however, are merely exemplary. Embodiments may include any number of latches 314 each having shapes or sizes other than those shown in FIG. 4 and throughout. Some embodiments may include quick release containers having continuous latches that extend around neck circumferences and may be configured to engage continuous lower lid protrusions that extend around an inner circumference of the outer lid portion 302.

Figure 5:
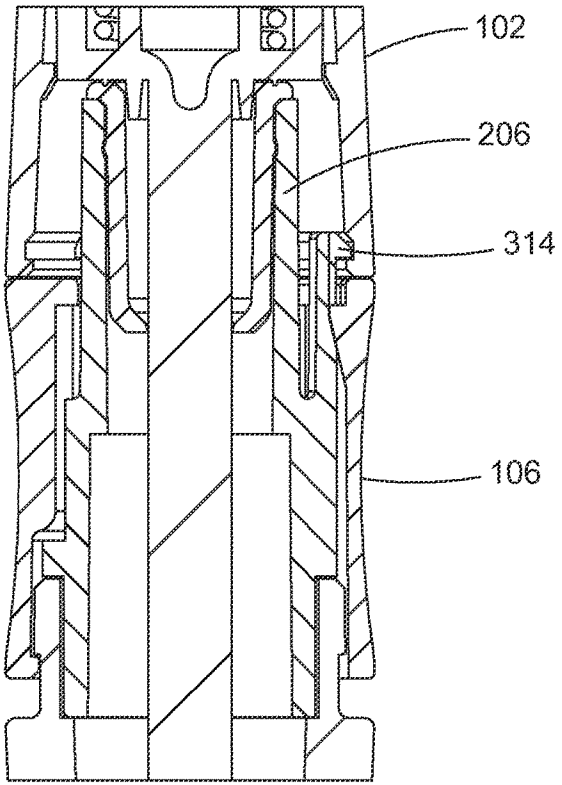
FIG. 5 is a close-up cross sectional view of a neck, a collar and a lid assembly of an exemplary quick release container in a closed position according to embodiments disclosed herein.
Figure 6B:
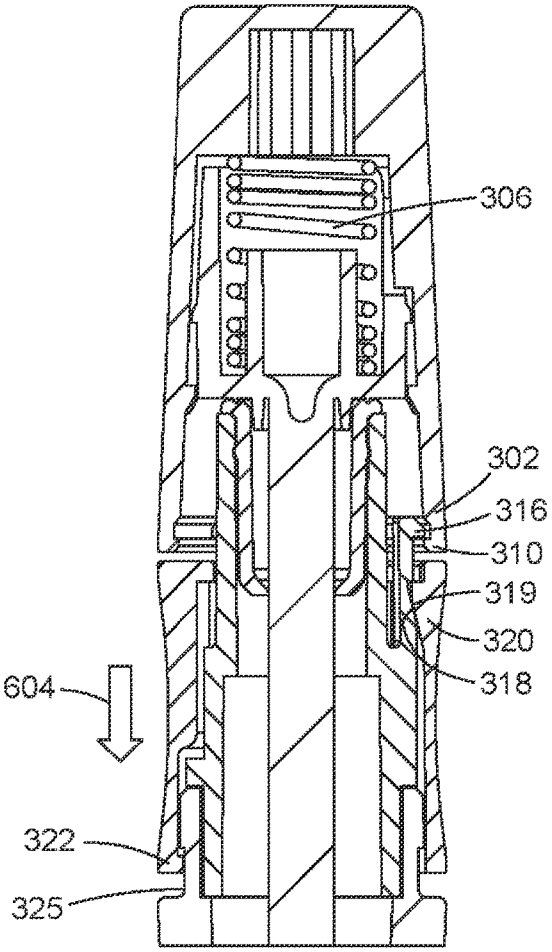
FIG. 6A through FIG. 6E are cross sectional views of a portion of an exemplary quick release container illustrating the assembly at different states according to embodiments disclosed herein.
Figure 6A:
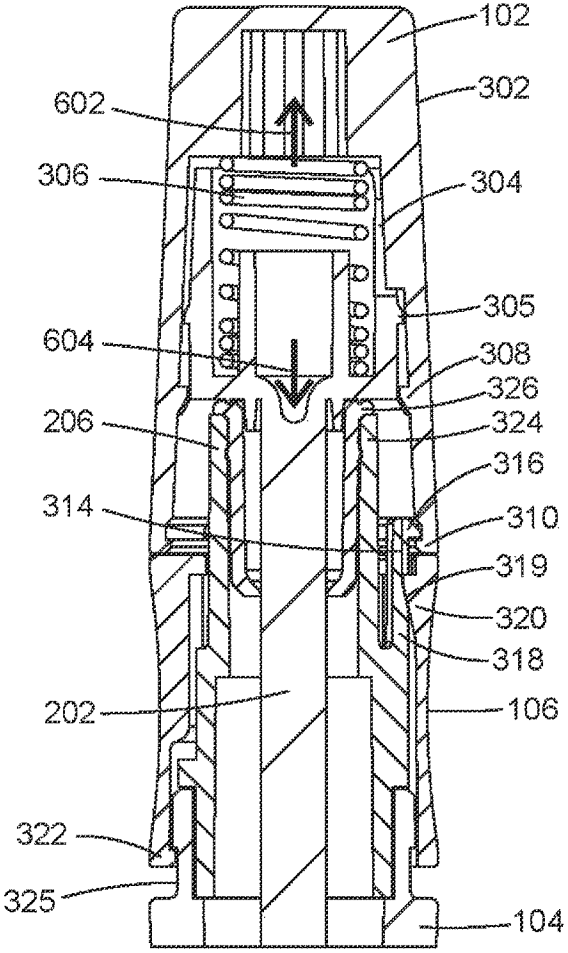
Figure 6E:
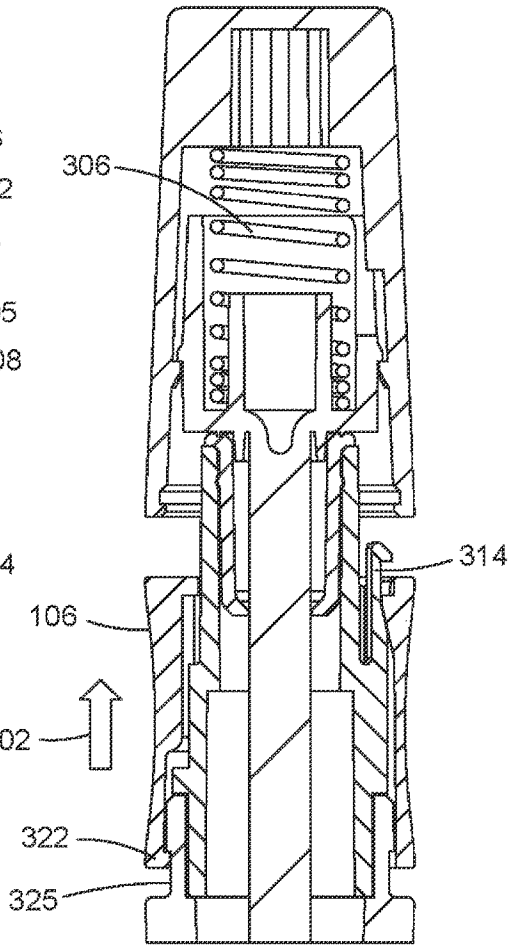
Figure 6D:
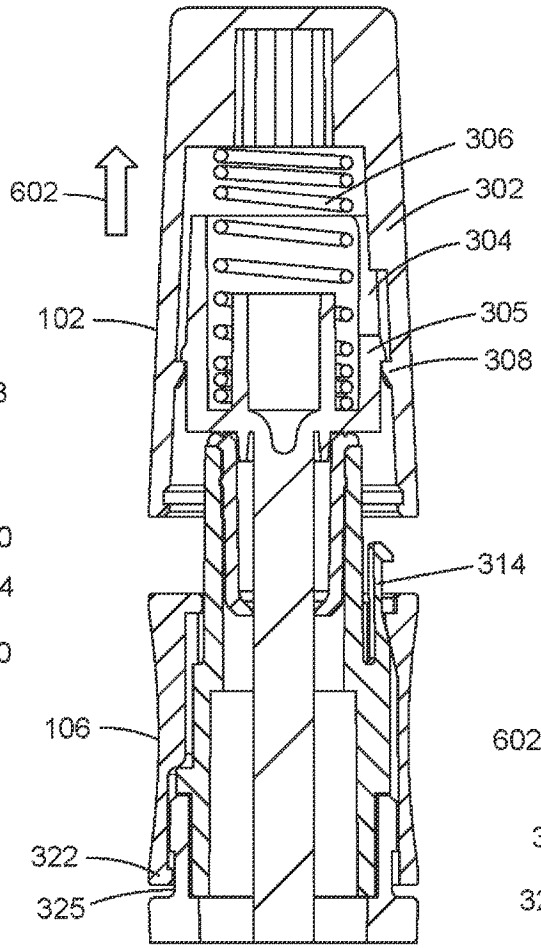
Figure 6C:
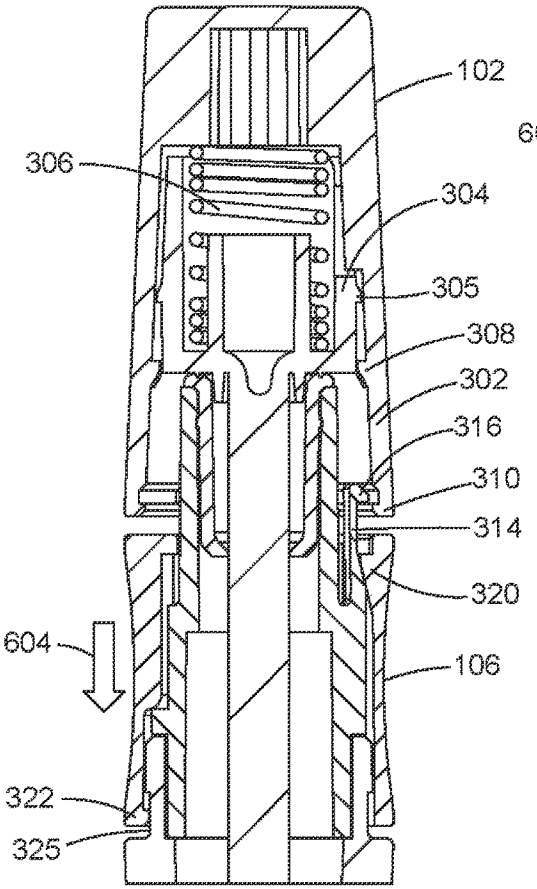
Figure 7C:
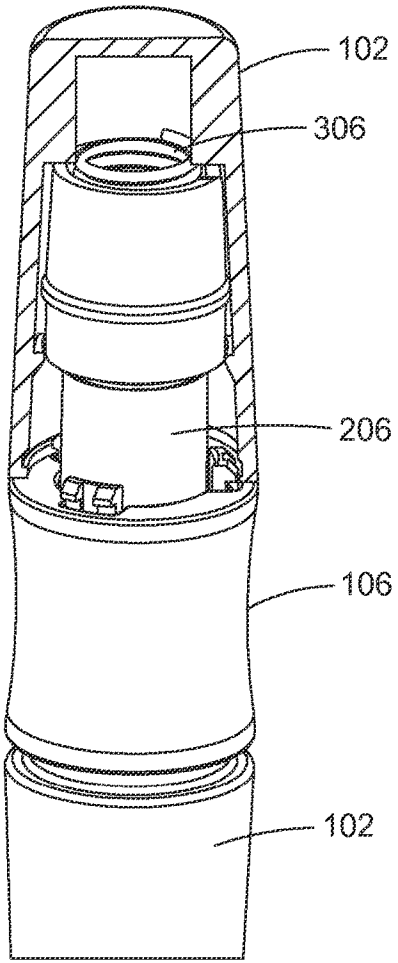
FIG. 7A through FIG. 7E are partial cross sectional views of an exemplary quick release container illustrating the assembly at different states according to embodiments disclosed herein.
Figure 7B:
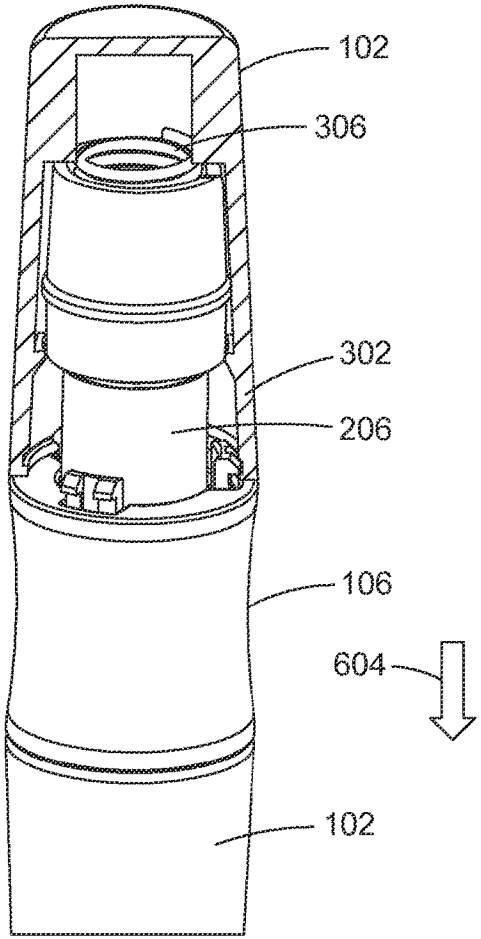
Figure 7A:
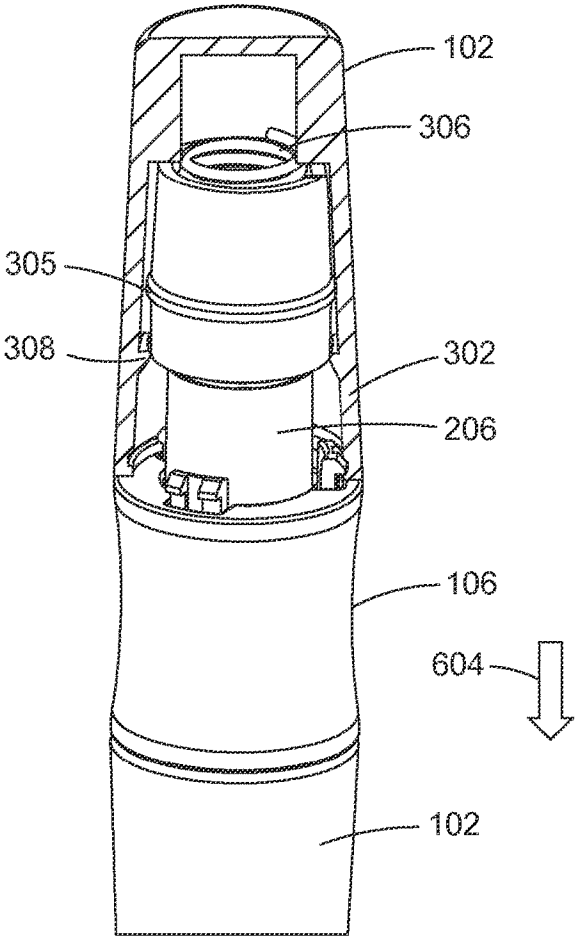

As shown in FIGS. 6A and 6B, each neck latch 314 may have a latch protrusion 316 that is configured to engage lower lid protrusion 310 when the quick release container 100 is in the closed position shown at FIG. 5, FIG. 6A and FIG. 7A. Each latch 314 may include a flexible lower latch portion 318 extending from latch protrusion 316. As shown in FIG. 6A, the flexible lower latch portion 318 may include a sloped edge 319 configured to receive an opposing sloped edge of collar protrusion 320 when in the closed position. In some embodiments, as shown for example in FIGS. 6A through 6E, neck 206 may include an outer neck portion 324 and an inner neck portion 326 coupled to outer neck portion 324. In other embodiments, however, quick release containers may include a single unitary neck.

As shown in FIGS, 6A and 613, collar 106 may also include collar protrusion 320 extending inward from the collar 106 and configured to contact and move relative to lower latch portion 318. Collar 106 may also include a lower collar portion 322 configured to contact and move along an upper portion of base 104, such as recess 325.

Movement between various states of the exemplary quick release container 100 will now be described with reference to FIG. 5, FIG. 6A through FIG. 6E and FIG. 7A through FIG. 7E. FIG. 5 is a close-up cross sectional view of neck 206, collar 106 and a portion of lid assembly 102 in a closed position according to embodiments disclosed herein. FIG. 6A through FIG. 6E are cross sectional views of a portion of an exemplary quick release container illustrating the assembly at different states according to embodiments disclosed herein. FIG. 7A through FIG. 7E are partial cross sectional views of the exemplary quick release container 100 illustrating the assembly at different states, substantially corresponding to those of FIG. 6A through FIG. 6E, according to embodiments disclosed herein.

In the closed position state shown at FIGS. 6A and 7A (and in larger format in FIG. 5), outer lid portion 302 of lid assembly 102 is in contact with top of collar 106. In some embodiments, for aesthetic or other purposes, outer lid portion 302 of lid assembly 102 may be in close proximity to the top of collar 106 without contacting collar 106. When in the closed position, lower lid protrusion 310 of outer lid portion 302 is engaged with latch protrusion 316 of neck 206. Further, when in the closed position, spring 306 of lid assembly 102 is in a compressed state and exerts a spring force in opposing directions as shown by arrows 602 and 604. Despite the spring force in opposing directions 602 and 604, quick release container 100 remains in the closed position because: (i) inner lid portion 304 is prevented from moving in direction 604 due to the contact between inner lid portion 304 and top of neck 206; and (ii) outer lid portion 302 is prevented from moving in direction 602 due to the contact between lower lid protrusion 310 of outer lid portion 302 and latch protrusion 316 of neck 206.

In the state shown at FIGS. 6B and 7B, collar 106 is moved (by a user not shown) in the direction 604 such that lower collar portion 322 moves along recess 325 in the direction of arrow 604 and collar protrusion 320 is moved in the direction 604 from its position in FIG. 6A. Note the gap between collar 106 and outer lid portion 302, as compared to FIG. 6A. As collar protrusion 320 is moved in the direction 604, collar protrusion 320 moves along the sloped edge 319 of flexible lower latch portion 318 as shown in FIG. 6B, thereby exerting an inward force against neck latch 314 and causing latch protrusion 316 to move inward away from outer lid portion 302. Similar action occurs at each neck latch 314. In other embodiments, collar protrusions and lower latch portions may have sloped edges in direction opposite to the directions shown in FIG. 6B and FIG. 7B and collars may be moved in the direction 602 to exert the inward force against neck latches. In some embodiments, the collar may be affixed to the cap for movement thereon rather than on the base. In some embodiments, the flexible lower latch portion 318 may not include a sloped edge.

In the state shown at FIGS. 6C and 7C, collar 106 is moved further (note the growing gap) in the direction 604 such that lower collar portion 322 moves further along recess 325 in the direction of arrow 604 and collar protrusion 320 is moved further in the direction of arrow 604 from its position in FIG. 6B. As collar protrusion 320 is moved further in the direction of arrow 604, collar protrusion 320 continues to move along the sloped edge 319 of lower latch portion 318, as shown in FIG. 6C. Because of the sloped shape of the collar protrusion 320 and the sloped edge 319 of lower latch portion 318, the force exerted by collar protrusion 320 against neck latch 314 as collar protrusion 320 moves along the sloped edge 319, causes latch protrusion 316 to move further away from outer lid portion 302 and, eventually, become disengaged from lower lid protrusion 310 of outer lid portion 302, as shown in FIG. 6C.

Figure 7E:
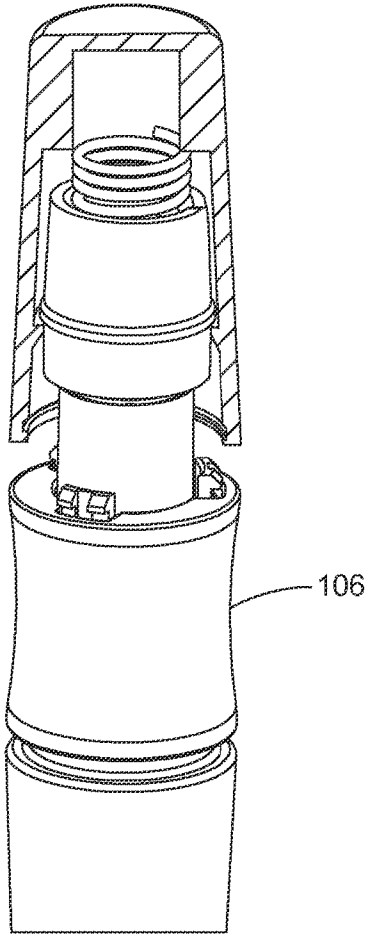
Figure 7D:
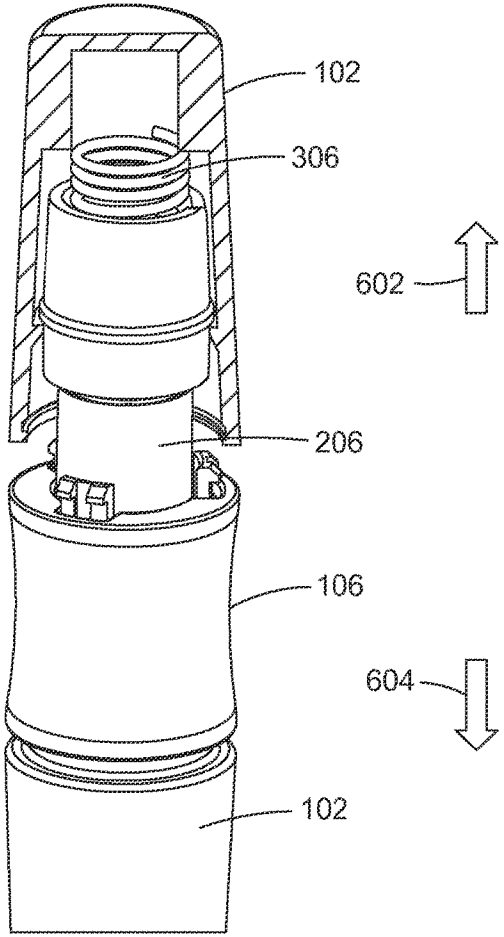

In arriving at the state shown at FIGS. 6D and 7D, with this disengagement, the force of spring 306 exerted on the outer lid portion 302 of lid assembly 102 in the direction of arrow 602 causes outer lid portion 302 of lid assembly 102 to move away from the top of collar 106 in the direction of arrow 602. Further, the force of spring 306 exerted on the outer lid portion 302 of lid assembly 102 in the direction of arrow 602 causes outer lid portion 302, of lid assembly 102 to move relative to inner lid portion 304. For example, as spring 306 decompresses, upper protrusion 308 of outer lid portion 302 moves from its position shown in FIG. 6C along a surface of inner lid portion 304 until upper protrusion 308 contacts inner lid protrusion 305, thereby preventing any further movement of lid assembly 102 in the direction of arrow 602. This arrangement is not strictly required, but is helpful in preventing the lid from undesirably popping off the base completely. In some embodiments, the spring force and distance of allowed travel is sufficient to allow disengagement and separation of latch protrusion 316 and collar protrusion 320, such that when the collar is released, the latches do not re-engage, and the lid can be removed from the base for normal use.

In the state shown at FIG. 6E and 7E, after outer lid portion 302 moves to its position shown at FIG. 6D, collar 106 moves in the direction of arrow 602 back to its original position shown in FIG. 6A. As depicted, the sloped nature of the neck latch 314 and the collar protrusion 320, act together via the resiliency of neck latch 314 to urge the collar 106 back to its original position. In one aspect, a coiled spring may be used to facilitate the collar 106 returning to its original position. Accordingly, lower collar portion 322 moves along recess 325 in the direction of arrow 602 and collar protrusion 320 also moves in the direction of arrow 602 back to its original position shown in FIG. 6A and the external force exerted on latch 314 by collar protrusion 320 is removed. Because latch 314 is made from a resilient, flexible, semi-rigid material (e.g. plastic), when the external force exerted by collar protrusion 320 is removed, latch 314 is resilient and may move back to its original position shown in FIG. 6E. Lid assembly 102 may then be easily removed (by user not shown) from quick release container 100. It should be recognized that the lid assembly 102 may be removed at any point after the latch 314 is disengaged from the collar, but it is not necessary for the collar to have returned to its original position to remove the lid. FIG. 2B shows the quick release container 100 with the lid assembly 102 removed.

In the embodiment shown in FIG. 6A through FIG. 6E, latch protrusion 316 disengages from lower lid protrusion 310 when the collar is moved in the direction 604 toward the base 104 due to the configuration of the sloped edge 319 of latch 314 and collar protrusion 320. In other embodiments, however, sloped latch edges and collar protrusions may be configured differently, such that collars may be moved in direction 602 toward lid assemblies to disengage latch protrusions from lower lid protrusions.

The size, shape, and dimensions of the exemplary quick release containers shown throughout are merely exemplary. For example, exemplary quick release containers may include outer diameters ranging from about 16 mm to about 22 mm. Exemplary jar and lid assemblies may also include jars having opening diameters ranging from about 30 min to about 100 mm. Exemplary jar and lid assemblies may further include heights ranging from about 25 mm to about 50 mm. For example, exemplary quick release containers may include but are not limited to the following dimensional combinations: 15×80 mm; 18×100 mm; 22×120 mm; 25×40 mm; 40×40 mm; 50×50 mm.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A quick release container comprising:

a base having a well configured to hold a product;

a neck coupled to the base, the neck comprising one or more latches each having: (i) a latch protrusion extending from the neck; and (ii) a flexible portion; and a lid assembly comprising:

an inner lid portion removably coupled to the neck;

an outer lid portion configured to at least partially house the inner lid portion and configured to be movable relative to the inner lid portion, the outer lid portion having one or more first lid protrusions configured to prevent movement of the outer lid portion in a first direction relative to the inner lid portion when the one or more first lid protrusions are engaged with one or more of the latch protrusions; and a biasing element coupled between the inner lid portion and the outer lid portion and configured to apply a biasing force to the outer lid portion in the first direction; and a collar at least partially housing the neck and configured to move between the outer lid portion and the base in the first direction, the collar having one or more collar protrusions configured to engage the flexible portions of the one or more latches and cause the one or more latch protrusions to disengage from the one or more first lid protrusions and facilitate movement of the outer lid portion in the first direction relative to the inner lid portion;

wherein the collar is moveable relative to the neck to cause the collar protrusions to move the one or more latches.

2. The quick release container according to claim 1, wherein the one or more latches are configured to flex from corresponding original latch positions when the one or more collar protrusions are moved from an original collar position along the flexible portions of the one or more latches, and the one or more latches disengage from the one or more first lid protrusions when the one or more latches flex from their corresponding original latch positions.

3. The quick release container according to claim 2, wherein the collar is further configured to move in a second direction opposite the first direction, and the one or more latches are configured to deflex and return to their corresponding original positions when the collar moves in the second direction.

4. The quick release container according to claim 2, wherein the neck comprises an opening providing access to the well of the base, the quick release container further comprises a brush stem extending from the inner lid portion into the well through the opening of the neck, and the brush stem is configured to be removed from the well when the lid assembly is removed from the quick release container.

5. The quick release container according to claim 4, wherein the quick release container further comprises an applicator coupled to a distal end of the brush stem.

6. The quick release container according to claim 5, wherein the brush stem is fixed to the neck.

7. The quick release container according to claim 4, wherein the inner lid portion and the brush stem are unitary.

8. The quick release container according to claim 4, wherein the inner lid portion and the brush stem are separate elements that are coupled together.

9. The quick release container according to claim 1, wherein the flexible portion comprises a sloped portion, and the one or more collar protrusions are each configured to move along the sloped portion of the one or more latches and cause the one or more latch protrusions to disengage from the one or more first lid protrusions and facilitate movement of the outer lid portion in the first direction relative to the inner lid portion.

10. The quick release container according to claim 1, wherein the biasing element is a spring.

11. The quick release container according to claim 1, wherein the collar is convex shaped to receive one or more fingers of a user and facilitates movement of the collar in the first direction or a second direction.

12. The quick release container according to claim 1, wherein the inner lid portion comprises one or more inner lid protrusions extending away from an outer circumference of the inner lid portion, the outer lid portion further comprises one or more second lid protrusions extending away from an inner circumference of the outer lid portion and spaced from the one or more inner lid protrusions, the one or more second lid protrusions of the outer lid portion are configured to move along an outer surface of the inner lid portion in the first direction when the outer lid portion moves in the first direction, and the one or more inner lid protrusions are configured to prevent further movement of the outer lid portion in the first direction when the one or more inner lid protrusions contact the one or more corresponding second lid protrusions.

13. The quick release container of claim 1 wherein the collar protrusions extend in a radially inward direction and have an inward facing sloped portion configured to engage in an axially sliding manner with the flexible portions of the one or more latches, such that when a user moves the collar in contrary to the biasing force, the collar protrusions apply an inward force on the one or more latches causing the one or more latches to disengage from the lid protrusions as the collar is moved in the first direction.

14. A quick release container comprising:

a base having a well configured to hold a product;

a neck coupled to the base, the neck comprising one or more latches, the one or more latches having a flexible portion; and a lid assembly comprising:

an inner lid portion;

a brush stem extending from the inner lid portion into the well through an opening in the neck;

an outer lid portion configured to be movable relative to the inner lid portion, and a biasing element coupled between the inner lid portion and the outer lid portion and configured to apply a biasing force to the outer lid portion to move the outer lid portion away from the inner lid portion; and a collar comprising one or more collar protrusions configured to engage the flexible portion of the one or more latches and cause the one or more latches to move away from and disengage from one or more corresponding first lid protrusions on an inner surface of the outer lid portion to facilitate the movement of the outer lid portion away from the inner lid portion;

wherein the collar is moveable relative to the neck to cause the collar protrusions to move the one or more latches.

15. The quick release container according to claim 14, wherein the one or more corresponding first lid protrusions are configured to prevent movement of the outer lid portion in a first direction relative to the inner lid portion when the one or more first lid protrusions are engaged with one or more latch protrusions.

16. The quick release container according to claim 15, wherein the one or more latch protrusions comprise a plurality of latch protrusions spaced from each other around an outer circumference of the neck.

17. The quick release container according to claim 14, wherein the flexible portion includes a sloped portion, and the one or more collar protrusions are configured to move along the sloped portion of the one or more latches in a direction away from the outer lid portion and toward the base.

18. The quick release container of claim 14 wherein the collar protrusions extend in a radially inward direction and have an inward facing sloped portion configured to engage in an axially sliding manner with the flexible portions of the one or more latches, such that when a user moves the collar in the first direction, the collar protrusions apply an inward force on the one or more latches causing the one or more latches to disengage from the lid protrusions as the collar is moved in the first direction.

19. The quick release container according to claim 14, wherein the inner lid portion and the brush stem are unitary.

* * * * *